US009511257B2

(12) United States Patent
Jung

(10) Patent No.: US 9,511,257 B2
(45) Date of Patent: Dec. 6, 2016

(54) EXERCISE EQUIPMENT FOR REHABILITATION OF HAND GRIP AND WRIST

(71) Applicant: SOONCHUNHYANG UNIVERSITY INDUSTRY ACADEMY COOPERATION FOUNDATION, Chungcheongnam-do (KR)

(72) Inventor: Bong-Keun Jung, Asan-si (KR)

(73) Assignee: SOONCHUNHYANG UNIVERSITY INDUSTRY ACADEMY COOPERATION FOUNDATION, Asan-Si, Chungcheongnam-Do (KR)

( * ) Notice: Subject to any disclaimer, the term of this patent is extended or adjusted under 35 U.S.C. 154(b) by 0 days.

(21) Appl. No.: 14/810,419

(22) Filed: Jul. 27, 2015

(65) Prior Publication Data

US 2016/0144228 A1 May 26, 2016

(30) Foreign Application Priority Data

Nov. 20, 2014 (KR) ..... 10-2014-0162408

(51) Int. Cl.
*A63B 24/00* (2006.01)
*A63B 23/035* (2006.01)
(Continued)

(52) U.S. Cl.
CPC ..... *A63B 23/03508* (2013.01); *A61H 1/0285* (2013.01); *A63B 21/02* (2013.01);
(Continued)

(58) Field of Classification Search
CPC ..... A61B 5/1071; A61B 5/013; A61B 5/1125; A61B 21/002; A63B 21/002; A63B 23/03508; A63B 23/14; A63B 23/16;A63B 21/02; A63B 21/023; A63B 21/025; A63B 21/05; A63B 21/4035; A63B 21/4019; A63B 21/4021; A63B 21/4025; A63B 24/0062; A61H 1/0285; A61H 2201/5071; A61H 2201/5084
See application file for complete search history.

(56) References Cited

U.S. PATENT DOCUMENTS 6,651,352 B2 * 11/2003 McGorry ..... A61B 5/1071 33/512
7,373,721 B2 * 5/2008 Bergamasco ..... A61B 5/1071 33/1 N
(Continued)

FOREIGN PATENT DOCUMENTS

KR 10-2012-0054723 A 5/2012
KR 1323105 10/2013
(Continued)

OTHER PUBLICATIONS

European Search Report for EP15188181 mailed Mar. 18, 2016 from European Patent Office.

*Primary Examiner* — Glenn Richman
(74) *Attorney, Agent, or Firm* — Revolution IP, PLLC

(57) ABSTRACT

An exercise equipment for rehabilitation of hand grip and wrist is disclosed herein. The exercise equipment includes a fixing module being fixed to a forearm of a user, a wrist exercising module having a hinge shaft on one side of the fixing module and being connected to the fixing module so as to be capable of performing rotating movements when rotating the arm, and a hand grip exercising module being provided on the wrist exercising module and measuring a hand grip of the user.

8 Claims, 3 Drawing Sheets

(51) Int. Cl.

| | |
|---|---|
| ***A61H 1/02*** | (2006.01) |
| ***A63B 21/02*** | (2006.01) |
| ***A63B 21/05*** | (2006.01) |
| ***A63B 23/14*** | (2006.01) |
| ***A63B 23/16*** | (2006.01) |
| *A63B 23/00* | (2006.01) |

(52) U.S. Cl.

CPC ..... *A63B 21/023* (2013.01); *A63B 21/025* (2013.01); *A63B 21/05* (2013.01); *A63B 21/4019* (2015.10); *A63B 21/4021* (2015.10); *A63B 21/4025* (2015.10); *A63B 21/4035* (2015.10); *A63B 23/14* (2013.01); *A63B 23/16* (2013.01); *A63B 24/0062* (2013.01); *A61H 2201/5071* (2013.01); *A61H 2201/5084* (2013.01); *A61H 2230/60* (2013.01); *A63B 2023/006* (2013.01); *A63B 2220/40* (2013.01); *A63B 2220/56* (2013.01)

(56) References Cited

U.S. PATENT DOCUMENTS

| | | | | |
|---|---|---|---|---|
| 8,337,441 | B2 * | 12/2012 | Colditz | A61F 5/013 602/21 |
| 2002/0155925 | A1 * | 10/2002 | Smith | A63B 21/002 482/4 |
| 2009/0197741 | A1 | 8/2009 | Poillucci et al. | |
| 2010/0234182 | A1 * | 9/2010 | Hoffman | A61B 5/1125 482/8 |
| 2014/0228178 | A1 | 8/2014 | Brooks et al. | |

FOREIGN PATENT DOCUMENTS

| | | | |
|---|---|---|---|
| KR | 10-1380778 | | 4/2014 |
| KR | 10-1380778 | B1 | 4/2014 |
| WO | 2004/050172 | A1 | 6/2004 |
| WO | 2012/120393 | A2 | 9/2012 |

* cited by examiner

EXERCISE EQUIPMENT FOR REHABILITATION OF HAND GRIP AND WRIST

CROSS REFERENCE TO PRIOR APPLICATION

This application claims priority to Korean Patent Application No. 10-2014-0162408 filed Nov. 20, 2014, which is hereby incorporated by reference in its entirety.

BACKGROUND

The present invention relates to a rehabilitation equipment and, most particularly, to an exercise equipment for rehabilitation of hand grip and wrist.

Generally, a hand grip refers to a level of strength that is used for holding or grabbing an object by using the palm of the hand, such grip is performed by upper limb muscles (mostly forearm flexor muscles and hand muscles) and static muscle strength. Recently, diverse methods for measuring hand grip have been used in order to perform physical rehabilitation exercise and examination of patients who carry out only a small amount of physical activity, such as elderly patients.

A regular hand grip meter that is being introduced in the physical fitness measurement manual includes a Collin type, a McCloy type, and a Smedley type.

However, the related art hand grip exerciser and muscle trainer are disadvantageous in providing a limited (or restricted) level of freedom to users when performing exercise (or workout or training) depending upon their features and specification of such exercisers and trainers. Moreover, in order to allow the user to train diverse muscles existing in the user's hands and arms, the user is required to separately use adequate exercise equipments for the respective body parts (or muscle area).

SUMMARY

Accordingly, the present invention is directed to an exercise equipment for rehabilitation of hand grip and wrist that substantially obviates one or more problems due to limitations and disadvantages of the related art.

An object of the present invention is to provide an exercise equipment for rehabilitation of hand grip and wrist that can allow the user to perform rehabilitation exercises for enhancing finger strength and wrist strength by using only one equipment.

Another object of the present invention is to provide an exercise equipment for rehabilitation of hand grip and wrist that can allow a rehabilitation level of the hand grip and the wrist strength to be easily measured.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an exercise equipment for rehabilitation of hand grip and wrist includes a fixing module being fixed to a forearm of a user, a wrist exercising module having a hinge shaft on one side of the fixing module and being connected to the fixing module so as to be capable of performing rotating movements when rotating the arm, and a hand grip exercising module being provided on the wrist exercising module and measuring a hand grip of the user.

Additionally, the fixing module may include a supporting part having the arm of the user secured thereto, and a belt part being wrapped around the user's arm that is secured to the supporting unit, thereby establishing a state of being fixed to the supporting part.

Additionally, the wrist exercising module may include a rotating part having a hinge part on one end of the supporting part, being installed to be capable of performing rotating movements, and having an empty space formed therein, and an elastic member being provided on the hinge part so as to be capable of performing rotating movements when a predetermined amount of external force is applied to the rotating part.

Additionally, the hand grip exercising module may include an upper pressure applying part and a lower pressure applying part each being provided inside the rotating unit and having a supplementary hinge part formed therein and being installed to perform respective rotating movements so as to allow the upper pressure applying part and the lower pressure applying part touch one another with respect to the supplementary hinge part, and a supplementary elastic member being provided on the supplementary hinge part so as to allow the upper pressure applying part and the lower pressure applying part to perform relative rotating movements, when a predetermined amount of external force is applied to the upper pressure applying part and the lower pressure applying part.

And, finally, the exercise equipment may further include an acceleration sensor measuring a rotation speed of the rotating unit, a pressure sensor measuring a pressure level being applied to the upper pressure applying part, a lighting unit allowing the pressure sensor to indicate to the user when the applied pressure level is equal to or greater than a predetermined pressure level, and a controller being electrically connected to the acceleration sensor, the pressure sensor, and the lighting unit.

It is to be understood that both the foregoing general description and the following detailed description of the present invention are exemplary and explanatory and are intended to provide further explanation of the invention as claimed.

BRIEF DESCRIPTION OF THE DRAWINGS

The characteristics and advantages of the present invention may be understood more easily with the detailed description of the exemplary embodiments of the present invention, which will hereinafter be provided, along with the accompanying drawings, which will be briefly described as follows. In the drawings.

DETAILED DESCRIPTION

Hereinafter, preferred embodiments of the present invention, through which objects of the present invention can be realized in detail, will be described in more detail with reference to the accompanying drawings. However, the accompanying drawings will be described merely to facilitate the disclosure of the contents of the present invention, and, therefore, it will be apparent to anyone skilled in the art that the scope of the present invention will not be limited to the scope of the accompanying drawings. First of all, a structure according to a preferred embodiment of the present invention will be described in detail with reference to the accompanying drawings.

Figure 1:
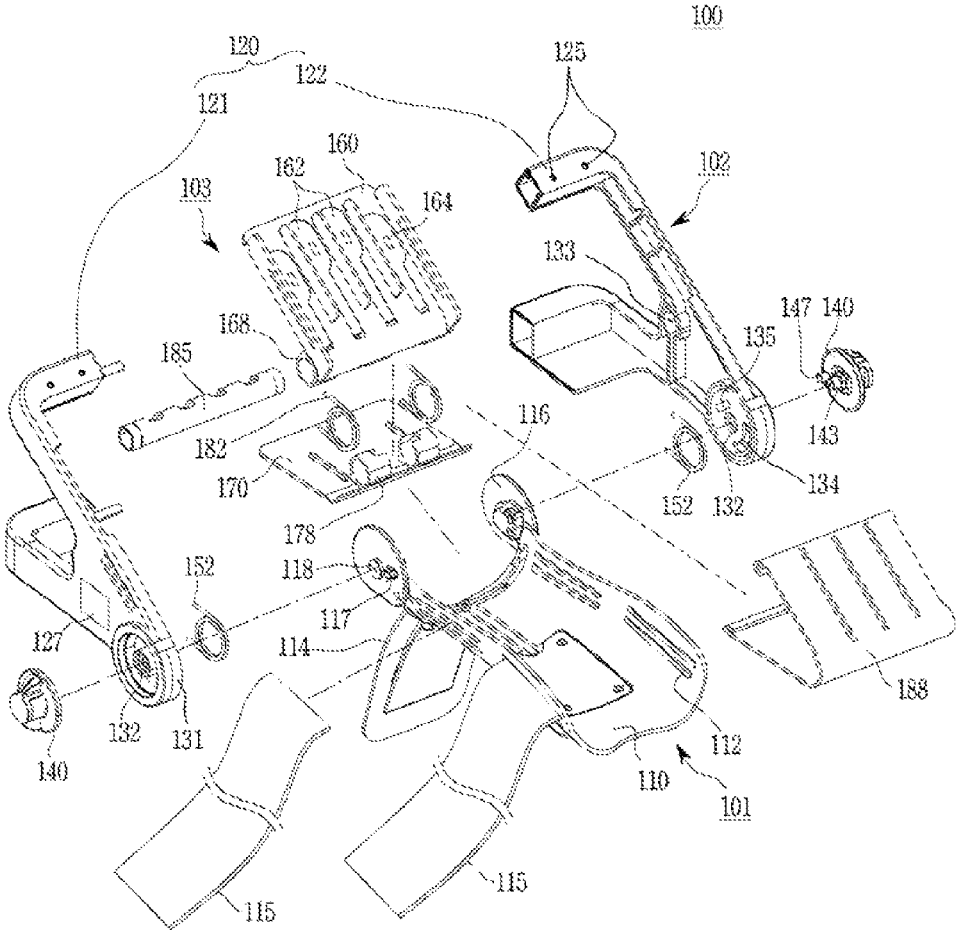
FIG. 1 illustrates a dispersed perspective view showing a connection relationship between main components configuring an exercise equipment for rehabilitation of hand grip and wrist according to an embodiment of the present invention.
Figure 2:
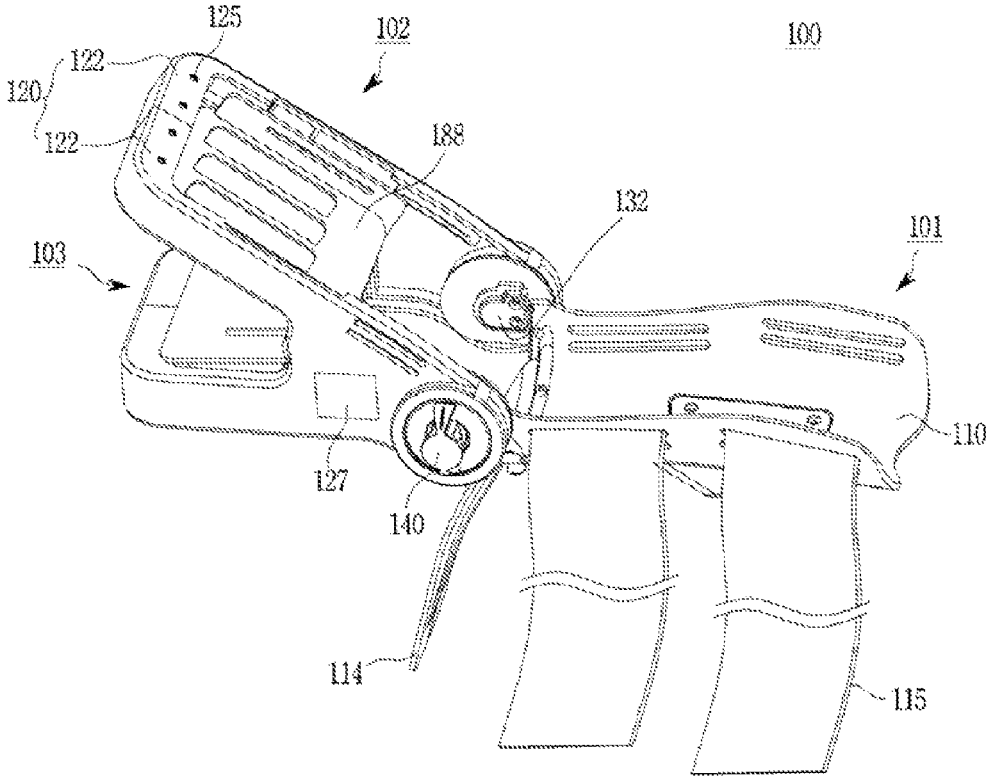
FIG. 2 illustrates a perspective view showing the exercise equipment for rehabilitation of hand grip and wrist according to an embodiment of the present invention.

FIG. 1 illustrates a dispersed perspective view showing a connection relationship between main components configuring an exercise equipment for rehabilitation of hand grip and wrist according to an embodiment of the present invention, and FIG. 2 illustrates a perspective view showing the exercise equipment for rehabilitation of hand grip and wrist according to an embodiment of the present invention.

As shown in the drawings, the exercise equipment for rehabilitation of hand grip and wrist 100 according to the present invention includes a fixing module 101, a wrist exercising module 102, and a hand grip exercising module 103 as its main components.

The fixing module 101 is configured to be fixed to a user's arm, and, in order to do so, the fixing module 101 is configured to include a supporting part 110, which is configured to secure and support a forearm of the user, and a belt part 115, which is configured to maintain the fixed state of the supporting part 110 being fixed to the user's arm.

The supporting part 110 may be configured of a plastic or metallic material. And, the belt part 115 may be configured of fabric, leather, or a material having a predetermined level of elasticity. Herein, the belt part 115 may be secured by passing through a belt installation groove 112, which is provided in the supporting part 110, or a Velcro part (not shown) may be separately applied so that the belt part 115 can be fixed (or secured) to a predetermined position.

Subsequently, the wrist exercising module 102 has a hinge shaft on one side of the fixing module 101, and, the wrist exercising module 102 is rotatably connected to the fixing module 101, so as to be rotated along the hinge shaft when the user rotates (or turns or twists) his (or her) hand with respect to his (or her) wrist.

As shown in the drawing, the wrist exercising module 102 is configured to include a rotating part 120 rotating with respect to a hinge shaft, which is provided on one end of the fixing module 101, and an elastic member 152 allowing the rotating part 120 to perform relative rotating movements with respect to the fixing module 101 only when a predetermined amount of external force is applied to the rotating part 120.

At this point, the rotating part 120 includes a left rotating part 121 and a right rotating part 122, wherein each of the left rotating part 121 and the right rotating part 122 is respectively coupled with both sides of the supporting part 110, which configures the fixing module 101, thereby forming an empty space within the above-described structure.

Additionally, the supporting part 110 is provided with a securing bracket 116 on both sides. Each of the securing brackets 116 is provided with a coupling part 118, wherein its central axis acts as a rotation shaft and a first engaging part 117, which is spaced apart from the coupling part 118 at a predetermined distance so as to be connected to the elastic member 152, which will be described later on in detail.

Meanwhile, each of the left rotating part 121 and the right rotating part 122 is provided with a pivoting part 131, which is rotatably installed while facing into the securing bracket 116. And, the pivoting part 131 is provided with a connection hole 132, which is connected to the coupling part 118 by being rotatably inserted in the coupling part 118.

Herein, as shown in the drawing, the pivoting part 131 is provided with an adjustment hole 134 being positioned to be spaced apart from the rotation shaft at a predetermined distance and having its inside and outside passed through along a circumferential direction of the pivoting part 131.

Additionally, each of the left rotating part 121 and the right rotating part 122 is provided with an elastic adjusting part 140, which is installed on an outer side of the pivoting part 131.

The elastic adjusting part 140 is provided with an inserting part 143, which is being inserted in the connection hole 132, and the elastic adjusting part 140 is also provided with a second engaging part 147, which is configured to have a predetermined length sufficient to pass through the adjustment hole 134 so as to be partly exposed.

Although it is not specifically illustrated in the drawing, the elastic adjusting part 140 is installed on the pivoting part 131 so as to be rotated to a predetermined degree with respect to the hinge shaft. And, herein, a structure of a disclosed screw connection method or a forced insertion method or a screw method may be applied, in order to maintain the elastic adjusting part 140 to be fixed to the pivoting part 131 while being pivoted (or rotated) to a predetermined angle.

Meanwhile, an elastic member 152 having the form of a coil spring or a spiral spring is installed between the securing bracket 116 and the pivoting part 131. In order to allow the elastic member 152 to be easily installed, it will be preferable to maintain an empty space between the securing bracket 116 and the pivoting part 131 or between two or more of the members (or parts), so that the securing bracket 116 and the pivoting part 131 or other members (or parts) can be spaced apart from one another.

Additionally, one end of the elastic member 152 is configured to establish an engaged state, wherein the elastic member 152 is engaged with the first engaging part 117, and another end of the elastic member 152 establishes a state of being engaged with the second engaging part 147, which passes through the adjustment hole 134 so as to be exposed. Herein, the elastic member 152 is installed between the first engaging part 117 and the second engaging part 147 so that a predetermined level of elastic force can be applied thereto.

More specifically, since the second engaging part 147 can be rotated along with the rotating part 120, and since the first engaging part 117 forms a state of being fixed to the supporting part 110, the elastic member 152 is being installed so that the rotating part 120 can perform relative rotating movements only when a predetermined amount of external force is applied to the rotating part 120.

Furthermore, when the elastic adjusting part 140 is fixed to a state of being rotated to a predetermined degree, a position of the second engaging part 147 is adjusted by the adjustment hole 134, thereby allowing the elasticity of the elastic member 152 to also be adjusted.

Hereinafter, the hand grip exercising module 103 will be described in detail.

The hand grip exercising module 103 is equipped with a supplementary hinge part 185 on the inside of the rotating part 120. And, herein, the hand grip exercising module 103 also includes an upper pressure applying part 160 and a lower pressure applying part 170, which are installed so that each end part can contact one another by respectively rotating with respect to the supplementary hinge part 185.

The supplementary hinge part 185 is configured in a cylindrical form having a predetermined length, and an installation part 133 having both ends of the supplementary hinge part 185 installed thereto is provided on inner sides of the left rotating part 121 and the right rotating part 122.

Additionally, in order to allow the supplementary hinge part 185 to pass through, and in order to allow the upper pressure applying part 160 and the lower pressure applying part 170 to be installed to be capable of rotating with respect to the rotating axis of the supplementary hinge part 185, an upper pass through part 168 bring shaped as a ring is provided on the upper pressure applying part 160, and a lower pass through part 178 is provided on the lower pressure applying part 170. At this point, it is preferable that a plurality of the upper pass through part 168 and a plurality of the lower pass through part 178 are provided and alternately aligned.

Additionally, a supplementary elastic member 182 is provided to be capable of passing through the supplementary hinge part 185 and to be connected to the upper pressure applying part 160 and the lower pressure applying part 170 by having one side connected to the upper pressure applying part 160 and another side connected to the lower pressure applying part 170, thereby allowing the upper pressure applying part 160 and the lower pressure applying part 170 to perform relative rotating movements only when a predetermined amount of external force is applied to the upper pressure applying part 160 and the lower pressure applying part 170.

As shown in FIG. 1, the supplementary elastic member 182 is also configured to form a coil spring.

Meanwhile, the user's second to fifth fingers are placed on the upper pressure applying part 160, and the user's first finger, i.e., the user's thumb is placed on the lower pressure applying part 170, thereby allowing the user to apply pressure on both of the pressure applying parts 160 and 170.

At this point, a plurality of section ribs is provided in order to allow each of the fingers to be easily positioned, and a pressure sensor 164 is provided on each side of the ribs where each finger is respectively positioned.

Thereafter, a cover part 188, which is configured to simultaneously enveloping the upper pressure applying part 160 and the lower pressure applying part 170, is provided in order to conceal the pressure sensors 164 from the outside.

The cover part 188 is configured of a thin rubber material, and it is preferable to configure the cover part 188 so that pressure can be easily sensed by the pressure sensors 164, when pressure is applied to the pressure applying parts 160 and 170 by the user's fingers, and so that a comfortable fit can be provided.

Meanwhile, the rotating part 120 is provided with a lighting part 125 indicating a pressure level sensed (or detected) through each pressure sensor 164. It is preferable to provide a number of lighting parts 125 corresponding to the positions of each finger, and, herein, LED lamps may be applied. Additionally, a display unit 127 indicating a pressure value or a rotation speed or rotation value, which is detected (or identified) by the acceleration sensor 135, in numbers may be provided on one side of the rotating part 120.

Figure 3:
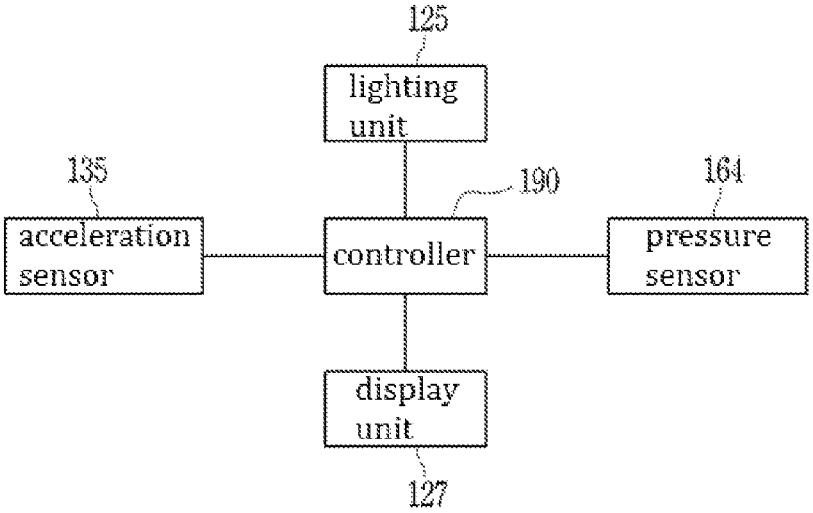
FIG. 3 illustrates a block view showing a connection relationship between main components configuring an exercise equipment for rehabilitation of hand grip and wrist according to an embodiment of the present invention.

FIG. 3 illustrates a block view showing a connection relationship between main components configuring an exercise equipment for rehabilitation of hand grip and wrist according to an embodiment of the present invention.

As shown in FIG. 1 to FIG. 3, the exercise equipment for rehabilitation 100 is separately provided with a controller 190, which performs a function of a microprocessor, and, herein, the controller 190 is configured to be electrically connected to the lighting unit 125, the display unit 127, the pressure sensors 164, and the acceleration sensor 135. Herein, the controller 190 may be installed on the supporting part 110 or the rotating part 120.

An operation process of the exercise equipment for rehabilitation of hand grip and wrist according to the embodiment of the present invention, which is configured as described above, with hereinafter be described in detail.

Figure 4:
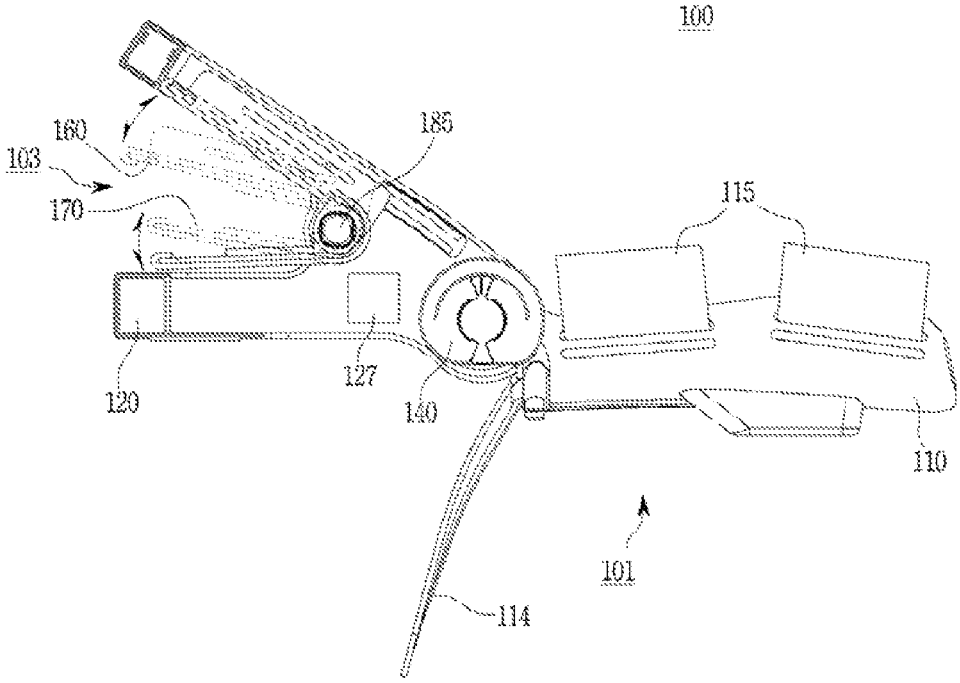
FIG. 4 illustrates a general view showing an operating state of the hand grip exercising module of FIG. 2.

FIG. 4 illustrates a general view showing an operating state of the hand grip exercising module of FIG. 2.

After the user inserts his (or her) hand inside the rotating part 120, and after the user fastens his (or her) arm by using the supporting part 110 and the belt part 115, the user places his (or her) thumb on the lower pressure applying part 170 and then places the remaining fingers on each of the respective sectional areas provided on the upper pressure applying part 160. Thereafter, when the user applies pressure with each of his (or her) fingers, the upper pressure applying part 160 and the lower pressure applying part 170 may perform rotating movements along directions allowing the pressure applying parts 160 and 170 to touch one another.

At this point, each of the pressure sensors 164 measures a level of applied pressure, which is applied by each finger of the user, and, then, by using the corresponding lighting unit 125 or the display unit 127, the measured pressure level may be visually displayed to the outside.

Figure 5:
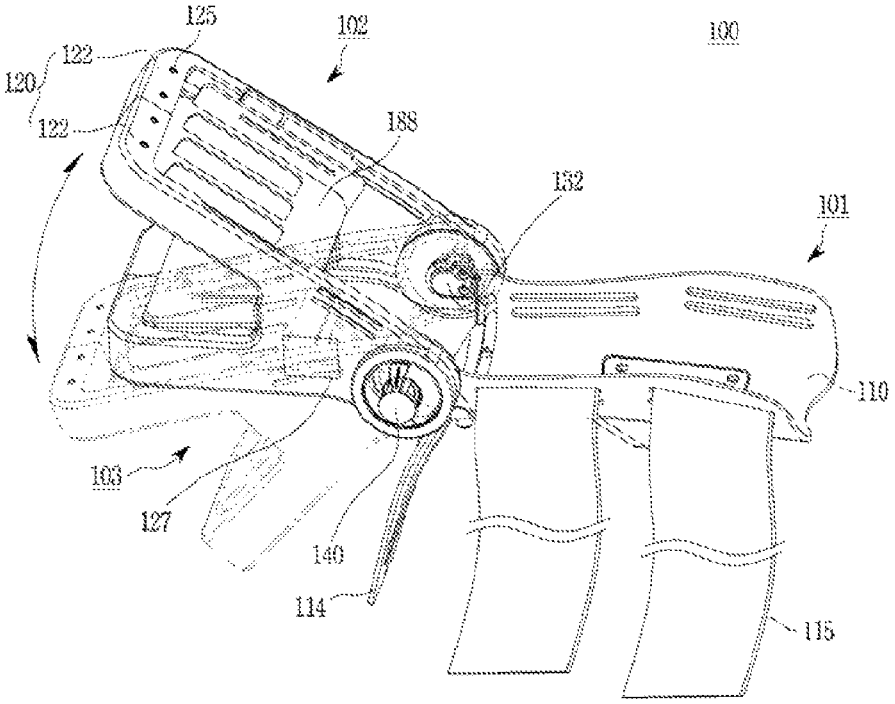
FIG. 5 illustrates a general view showing an operating state of the wrist exercising module of FIG. 2.

Additionally, as shown in FIG. 5, while the upper pressure applying part 160 and the lower pressure applying part 170 are touching one another, when the user moves his (or her) wrist downward, the rotating part 120 rotates downward with respect to the hinge shaft, which corresponds to the central axis of the coupling part 118.

At this point, the acceleration sensor 135 measures the movement speed and movement distance of the rotating part 120 and may then indicate the measured results to the user by using the display unit 127.

Although it is not specifically illustrated in the drawings, in order to facilitate the operations of the wrist exercise only, in some cases, the user may choose to optionally fix the upper pressure applying part 160 to the rotating part 120.

As a separate movable structure, a stopper may be applied to the rotating part 120, so as to allow the upper pressure applying part 160 to be fastened to the rotating part 120 so as to move along with the rotating part 120, or to allow the upper pressure applying part 160 to move separately.

As described above, according to the exercise equipment for rehabilitation of hand grip and wrist has the following advantages. According to the present invention, the exercise equipment for rehabilitation of hand grip and wrist may allow the user to perform rehabilitation exercises for enhancing finger strength and wrist strength by using only one equipment.

Most particularly, while enabling the strength of each finger to be measured, by allowing the user to visually verify his (or her) strength level by using a lighting unit and a display unit, by being capable of measuring the wrist strength at the same time, the rehabilitation treatment process may be easily followed.

Furthermore, after being configuring 190 to store the measurements taken during each rehabilitation exercise session, the controller 190 may notify an overall rehabilitation progress to the user.

Preferred embodiments of the present invention have been provided above in the detailed description of the present invention with reference to the appended drawings, and it will be apparent to those skilled in the art that various modifications and variations can be made in the present invention without departing from the spirit or scope of the inventions. Accordingly, the above-described embodiments of the present invention shall be understood only as exemplary embodiments that do not limit the scope of the present invention. Thus, it is intended that the present invention covers the modifications and variations of this invention provided they come within the scope of the appended claims and their equivalents.

What is claimed is:

1. An exercise equipment for rehabilitation of hand grip and wrist, comprising:

a fixing module being fixed to a forearm of a user;

a wrist exercising module having a hinge shaft on one side of the fixing module and a rotating part, the wrist exercising module being connected to the fixing module so as to be capable of performing rotating movements when rotating the arm, the rotating part being installed to be capable of performing rotating movements and having an empty space formed therein; and a hand grip exercising module being provided on the wrist exercising module and measuring a hand grip of the user, the hand grip exercising module having an upper pressure applying part and a lower pressure applying part, each of the upper pressure applying part and the lower pressure applying part being provided inside the rotating part and having a supplementary hinge part formed therein and being installed to perform respective rotating movements with respect to the supplementary hinge part.

2. The exercise equipment of claim 1, wherein the fixing module comprises:

a supporting part having the arm of the user secured thereto; and a belt part being wrapped around the user's arm that is secured to the supporting unit, thereby establishing a state of being fixed to the supporting part.

3. The exercise equipment of claim 2, wherein, the rotating part has a hinge part on one end of the supporting part, and the wrist exercising module further comprises an elastic member being provided on the hinge part so as to be capable of performing rotating movements when a predetermined amount of external force is applied to the rotating part.

4. The exercise equipment of claim 1, wherein the hand grip exercising module further comprises a supplementary elastic member being provided on the supplementary hinge part so as to allow the upper pressure applying part and the lower pressure applying part to perform relative rotating movements, when a predetermined amount of external force is applied to the upper pressure applying part and the lower pressure applying part.

5. The exercise equipment of claim 1, further comprising:

an acceleration sensor measuring a rotation speed of the rotating part;

a pressure sensor measuring a pressure level being applied to the upper pressure applying part;

a lighting unit allowing the pressure sensor to indicate to the user when the applied pressure level is equal to or greater than a predetermined pressure level; and a controller being electrically connected to the acceleration sensor, the pressure sensor, and the lighting unit.

6. The exercise equipment of claim 2, further comprising:

an acceleration sensor measuring a rotation speed of the rotating part;

a pressure sensor measuring a pressure level being applied to the upper pressure applying part;

a lighting unit allowing the pressure sensor to indicate to the user when the applied pressure level is equal to or greater than a predetermined pressure level; and a controller being electrically connected to the acceleration sensor, the pressure sensor, and the lighting unit.

7. The exercise equipment of claim 3, further comprising:

an acceleration sensor measuring a rotation speed of the rotating part;

a pressure sensor measuring a pressure level being applied to the upper pressure applying part;

a lighting unit allowing the pressure sensor to indicate to the user when the applied pressure level is equal to or greater than a predetermined pressure level; and a controller being electrically connected to the acceleration sensor, the pressure sensor, and the lighting unit.

8. The exercise equipment of claim 4, further comprising:

an acceleration sensor measuring a rotation speed of the rotating part;

a pressure sensor measuring a pressure level being applied to the upper pressure applying part;

a lighting unit allowing the pressure sensor to indicate to the user when the applied pressure level is equal to or greater than a predetermined pressure level; and a controller being electrically connected to the acceleration sensor, the pressure sensor, and the lighting unit.

* * * * *